United States Patent [19]

Hammond

[11] Patent Number: 4,644,111

[45] Date of Patent: Feb. 17, 1987

[54] TRANSFORMER SWITCH

[75] Inventor: Robert G. Hammond, Sussex, Wis.

[73] Assignee: RTE Corporation, Waukesha, Wis.

[21] Appl. No.: 808,445

[22] Filed: Dec. 11, 1985

[51] Int. Cl.[4] ..... H01H 19/54; H01H 27/00

[52] U.S. Cl. ..... 200/8 A; 200/11 J; 200/11 TC; 200/43.04; 200/43.08

[58] Field of Search ..... 200/8 R, 8 A, 11 R, 200/11 A, 11 C, 11 E, 11 G, 11 J, 11 K, 11 TW, 43.08, 329, 330, 333, 334, 336, 43.04

[56] References Cited

U.S. PATENT DOCUMENTS

| | | | |
|---|---|---|---|
| 1,873,527 | 8/1932 | Anfinnsen et al. | 200/8 A |
| 1,956,430 | 4/1934 | Turner | 200/8 A |
| 2,478,296 | 8/1949 | McArn et al. | 200/11 J |
| 3,394,236 | 7/1968 | Grundig et al. | 200/11 J |
| 3,803,370 | 4/1974 | Garcia | 200/11 J |
| 3,883,706 | 5/1975 | Glaser | 200/11 A |
| 3,912,886 | 10/1975 | Allen et al. | 200/11 A |
| 4,356,360 | 10/1982 | Volz | 200/11 J X |
| 4,558,193 | 12/1985 | Test | 200/11 R X |

*Primary Examiner*—J. R. Scott

[57] ABSTRACT

A multiposition rotary transformer switch including a molded switch housing including a bore, an interrupted mounting flange located intermediate the ends of the bore and an interrupted key flange at one end of the bore, the flanges each including slots located at equally spaced intervals, the slots in one flange being offset from the slots in the other flange and a number of fixed contacts mounted on said housing, a dual voltage shaft assembly including a shaft having a drive nut at one end and a pair of floating contacts at the other end, and a tap changer shaft assembly including a shaft having a drive nut at one end and a floating contact at the other end, the shaft assemblies being adapted to be mounted in the bore in the housing and a reversible cap adapted to be mounted on the switch housing to enclose the end of the shaft assemblies in one position and mounted on the drive nut on the shaft in the other position to selectively rotate the shaft assembly with respect to the fixed contacts, the cap being keyed into the drive nut before the shaft assembly can be rotated in the bore.

15 Claims, 13 Drawing Figures

TRANSFORMER SWITCH

BACKGROUND OF INVENTION

The present invention relates to dual voltage and tap changer transformer switches which are mounted internally to the transformer and operated externally of the transformer. Each switch, i.e. tap changer or dual voltage, is individually designed and assembled to accomplish a specific purpose. The housings are also specially designed to accommodate each type of switch. The switches are actuated by external closures or caps which protect the external portion of the switch and are inverted to actuate the switch.

SUMMARY OF THE INVENTION

The transformer switch, according to the present invention, utilizes a single housing to accommodate either a dual voltage switch shaft assembly or a tap changer switch shaft assembly. The housing is designed so that it can be formed in a single molding operation. Each of the switch contact assemblies includes a free floating contact or contacts which provide positive electrical contact with the fixed contacts provided on the switch housing. The stationary contacts are circular and symmetrical about the contacts center mounting hole thus providing an accurately positioned contact surface independent of contact tightness.

BRIEF DESCRIPTION OF THE DRAWINGS

The invention may be better understood and further advantages and uses thereof will be more readily apparent when the following detailed description is read in connection with the accompanying drawings, in which.

DESCRIPTION

Figure 2:
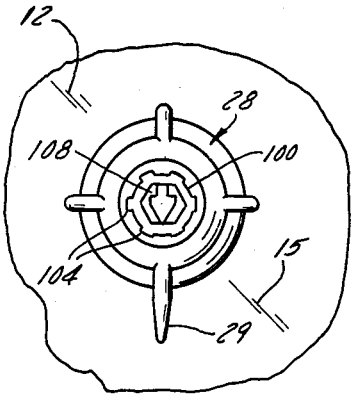
FIG. 2 is a front view of FIG. 1 showing the removable cap.
Figure 1:
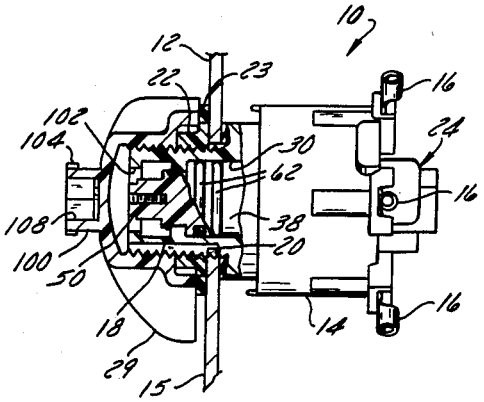
FIG. 1 is a side elevational view of the tap changer switch mounted in a transformer tank wall with a portion broken away to show the cap mounted on the switch housing.
Figure 3:
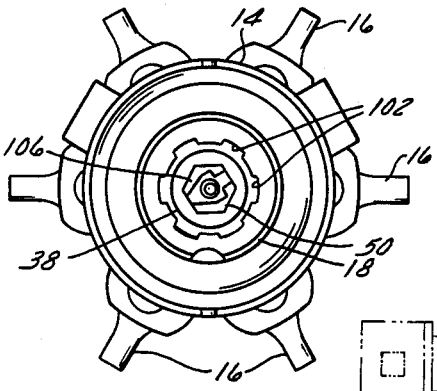
FIG. 3 is a front elevation view of FIG. 1 showing the switch with the cap removed.
Figure 7:
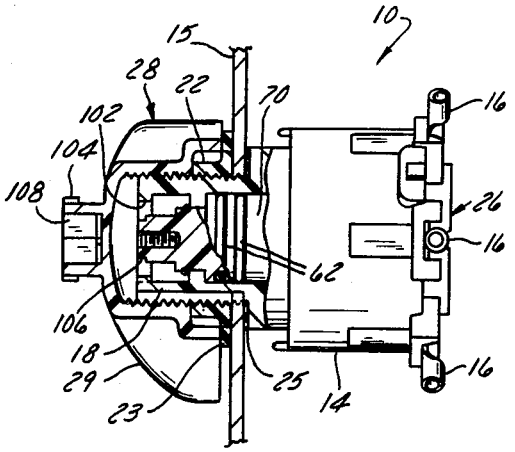
FIG. 7 is a side elevational view of the dual voltage switch shown mounted in the transformer tank wall with a portion broken away to show the cap mounted on the switch housing.
Figure 9:
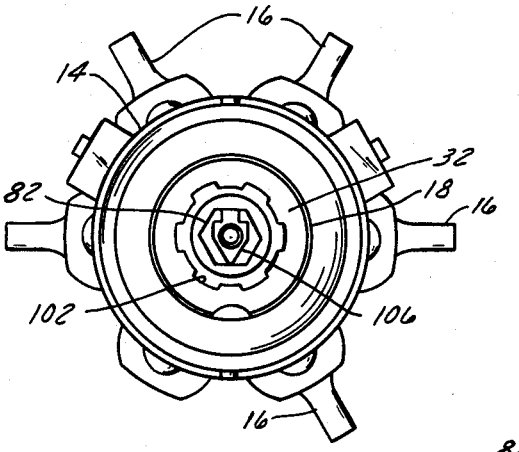
FIG. 9 is a front elevation view of the switch of FIG. 7 with the cap removed.
Figure 10:
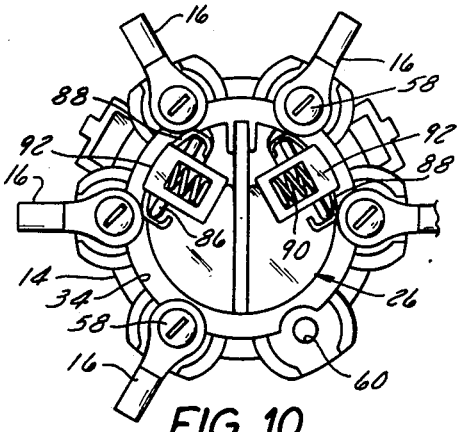
FIG. 10 is a rear elevation view of FIG. 7 with the fixed contacts shown in comaunication with the floating contacts of the dual voltage switch shaft assembly.

Referring to the drawings, and specifically FIGS. 1 and 7, the switch 10 is shown mounted on the wall 15 of a transformer tank 12 normally below the dielectric fluid contained within the transformer tank. The switch 10 generally includes a housing 14 having a number of fixed electrical contacts 16 mounted on the inner end of the housing. The housing includes a threaded reduced diameter section 18 having a key slot 17 that extends through an opening 20 having a positioning key 19 in the wall 15 of the transformer tank. The positioning key 19 corresponds to the key slot 17 to prevent rotation of the housing. The housing is secured in the opening 20 by means of a threaded nut 22 and seal ring 23 mounted on the threaded nut 22 and a seal ring 25 mounted on the threaded section 18. A pair of high voltage terminals 21, FIG. 4, may be provided on the housing for connecting the fixed contacts 16 to the transformer.

Figure 5:
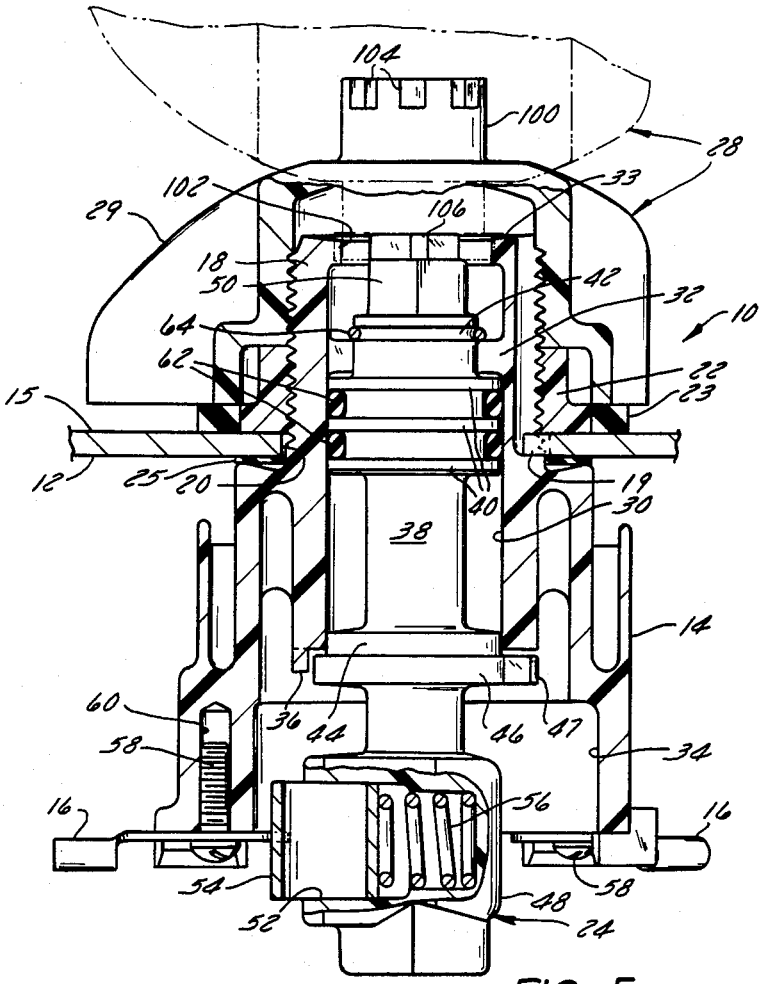
FIG. 5 is a section view of the switch showing the tap changer switch shaft assembly.
Figure 6:
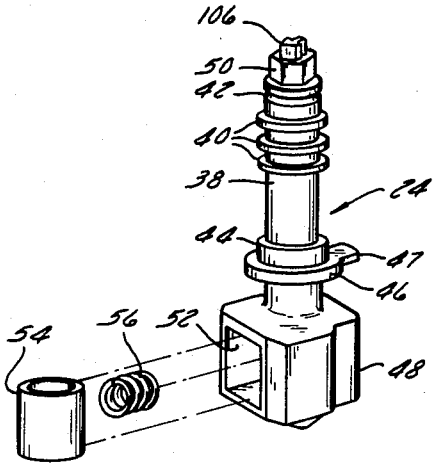
FIG. 6 is an exploded perspective view of the tap changer switch shaft assembly.
Figure 8:
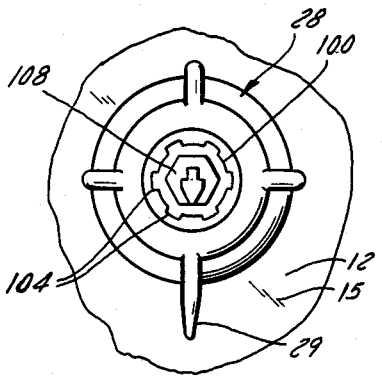
FIG. 8 is a front elevation view of the switch of FIG. 7 showing the cap.
Figure 11:
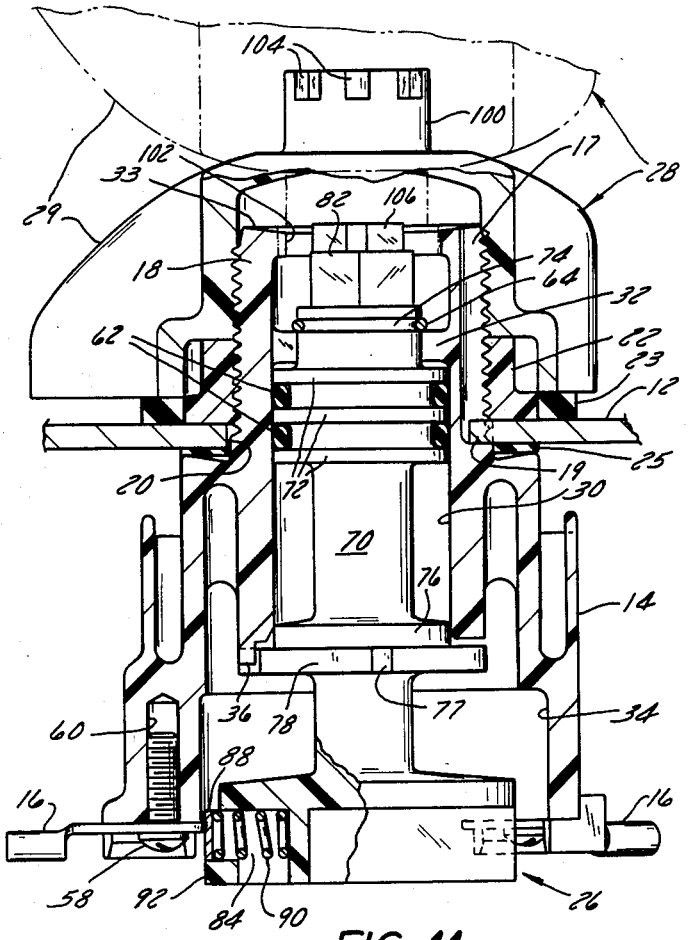
FIG. 11 is a section view of the dual voltage switch shaft assembly.
Figure 12:
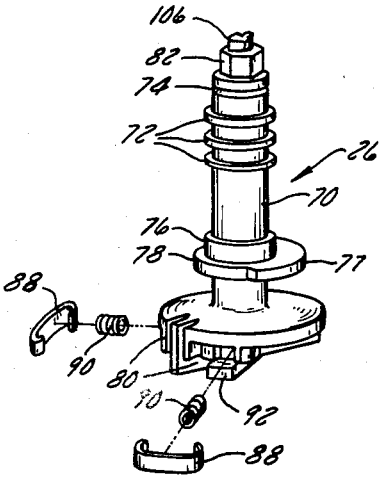
FIG. 12 is an exploded perspective view showing the floating contacts for the dual voltage switch shaft assembly.
Figure 13:
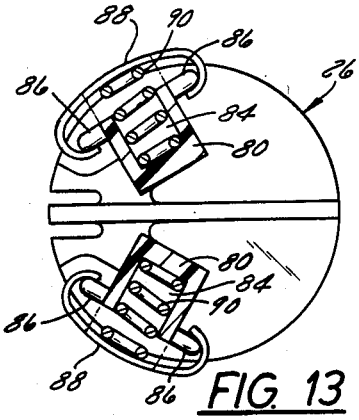
FIG. 13 is an end view partially in cross-section of the dual voltage switch shaft assembly.

The switch can be used either as a tap changer or a dual voltage switch depending on the type of selector switch shaft assembly that is provided in the housing 14. In this regard, it should be noted that the housing is adaptable for use with either of the selector switch shaft assemblies. If the switch is to be used as a tap changer, the switch shaft assembly 24 shown in FIGS. 5 and 6 is provided in the housing. If the switch is to be used as a dual voltage switch, the switch shaft assembly 26, shown in FIGS. 11 and 12 is provided in the housing. The shaft assemblies 24 and 26 are rotated by means of a cap 28 mounted on the threaded section 18 of the housing 14. A pointer 29 is provided on the cap 28 to indicate the position of the shaft assemblies 24 and 26 as described hereinafter.

One of the advantanges of this switch is the ability to use the same housing with either the tap changer or dual voltage shaft assembly. In this regard, the housing 14 is molded as a single unit having an axial bore 30 which forms the bearing surface for the shaft assemblies 24 and 26. An interrupted flange 32 is provided intermediate the ends of the bore 30 and an interrupted flange 33 is provided at the entrance to the bore 30. These flanges also make it possible to mold the housing in a single operation. A counterbore 34 is formed at the inner end of the housing to provide a recess for the switch operating elements of the shaft assemblies 24 and 26. A stop tab 36 is provided on the inner end of the bore 30.

The tap changer switch as seen in FIGS. 1–6 includes the shaft assembly 24 which is in the form of a shaft 38 having a series of flanges 40 mounted thereon and spaced at equal distances apart with a groove 42 at the outer end. A centering or locating ring 44 and a cam ring 46 are molded on the inner end of the shaft 38. A contact holder 48 is molded on the inner end of the shaft 38. Means in the form of a nut 50 is molded on the other end of the shaft 38 which is used to rotate the switch assembly in the housing 14. The holder 48 is provided with a recess or cavity 52 for housing a floating switch element or contact 54.

The switch element 54 is in the form of a tubular cylinder formed from an electrically conductive material such as copper. The element 54 is seated against a spring 56 located in the recess 52. The spring 56 is compressed by the switch element 54 the recess 52 to bias switch element into engagement with the switch contacts 16.

Figure 4:
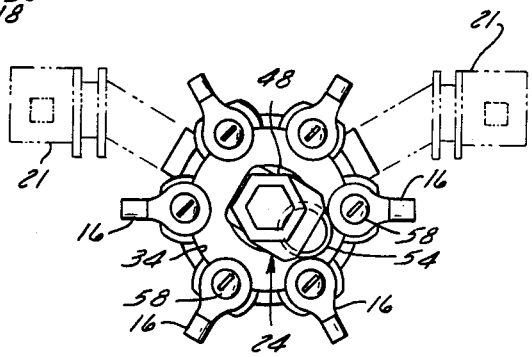
FIG. 4 is a rear view of FIG. 1 showing the fixed contacts engaged by a floating contact mounted in the tap changer switch shaft assembly with optional high voltage terminations shown on the housing.

In this regard and referring to FIG. 4, the floating switch element 54 is shown located between two of the contacts 16. Each of the contacts 16 is circular in shape and has a central opening 56. The contacts 16 are secured to the end of the housing by means of screws 58 that are turned into threaded openings 60 provided on the end of the housing 14. When the shaft assembly 24 is rotated, the cylinder 54 will be forced into the recess 52 against the bias of the spring 56 as the tubular element 54 moves past contacts 16. The force of the spring 56 acting on the element 54 is sufficient to cause the shaft assembly to rotate far enough for the cylinder 54 to be seated between the next two contacts 16. It should also be noted that the element 54 is long enough to compensate for loose or skewed contacts.

The shaft assembly 24 is mounted in the bore 30 with the centering ring 44 seated in the end of the bore 30 and the upper flange 40 in close proximity to the interrupted flange 32. O-ring seals 62 are provided between the flanges 40 to seal the shaft 38 in the bore 30. The shaft 38 is locked in the bore by a snap ring 64 provided in the groove 42 and located in a position to bear against interrupted flange 32 in the bore 30. The locating ring 44 and flanges 40 to center the shaft 38 in the bore 30.

Rotation of the shaft assembly 24 in either direction in the bore 30 is limited by means of a flange 47 provided on the cam ring 46. The flange 47 engages the limit stop tab 36 provided on the end of the bore 30 in either direction of rotation. The amount of rotation therefore being limited by the width of the flange 47.

In the embodiment of the invention shown in FIGS. 7 through 12, the dual voltage switch shaft assembly 26 is used to selectively connect the transformer windings either in parallel or in series. The shaft assembly 26 includes a shaft 70 having three flanges 72 spaced at equal intervals and a groove 74 at outer end of the shaft 70. A centering ring 76 and a cam ring 78 are provided at the inner end of the shaft 70. Rotation means in the form of a nut 82 is molded on the outer end of the shaft 70 for rotating the shaft assembly in the housing 14. Floating contact holders 80 are provided on the inner end of the shaft 70.

In this regard, the holders 80 include a recess or cavity 84 and a flange 86 on each side of the housing 80. A shoulder 92 is provided below the entrance to the cavity 84.

Electrical contact is provided between the contacts 16 by means of floating elements 88 in the form of conductive copper strips which are bent in the form of a "C." Each element 88 is mounted in the recesses 84 with the ends of the strips overlapping the flanges 86. The elements 88 are held in tight engagement with the flanges 86 by means of springs 90 which are compressed into the recesses 84 when the elements 88 are mounted on the flanges 86. The spring 90 biases the element 88 into engagement with the contacts 16. The elements 88 are prevented from dropping or falling from the flanges 86 by means of a shoulder 92 located at the entrance to the recesses 84. As indicated above, the bias force of the springs 90 is sufficient to center the floating elements 88 between the contacts 16. The element 88 is also wide enough to compensate for misaligned or loose contacts 16.

The dual voltage switch shaft assembly 26 is positioned in the bore 30 of the housing in the same relationship as described with respect to the tap changer switch shaft assembly 24. O-rings 62 are provided in the spaces between the flanges 72 to seal the switch element in the bore 30 and a snap ring 64 is positioned in the groove 74 to lock the element on to the interrupted flange 32.

The rotary motion of the shaft assembly 26 is limited by means of a flange 77 provided on the ring 78 on the shaft 70. The flange 77 when mounted in the bore 30 of the housing 14 is rotated into engagement with the stop tab 36 to positively locate the dual voltage switch shaft assembly in one of the two positions. It should be noted that the flange 77 is wider than flange 47 since shaft assembly 26 only rotates between two positions while shaft assembly 24 rotates through 5 positions.

Rotation of the shafts 38 and 70 is achieved by removing the cap 28 from the threaded section 18 of the housing and aligning circular boss 100 with the rotating nut 50 on the end of the shaft 38. The internal contour of the boss 100, having a configuration corresponding to the configuration of the positioning nut 50 in order to provide a connection for transmitting rotary motion to the shaft 70. Means are provided to positively locate the boss 100 on the positioning nut 50.

In this regard, the interrupted flange 33 at the end of the bore 30 is provided with slots 102 at equally spaced intervals. The boss 100 is provided with tabs 104, also at equally spaced intervals corresponding to the slots 102. The tabs 104 must be aligned with the slots 102 in the flange 33 in order to engage in the positioning nut 50.

Positive location of the cap 28 on the shaft assemblies 24 and 26 is provided by means of a protrusion 106 provided on the top of the nut 50. The protrusion means is in the form of an arrow molded on the top of the positioning nut 50. A corresponding arrow-shaped recess or indentation 108 is provided in the face of the boss 100 in the cap 28 with the arrow recess pointing in the same direction as the pointer 29 on the cap 28. When the cap 28 is properly aligned on the shaft assembly, the pointer 29 will point in the same direction as the arrow 106 on the end of the shaft 38 or 70. In order to rotate the shaft assemblies 24 and 26, the tabs 104 must pass completely through the slots 102 in the flange 33. If the arrow 106 on the end of the positioning nut 50 does not mate with the arrow indentation 108 in the face of the boss 100, the tabs 104 cannot clear the interrupted flange 33. If the arrow-shaped indentation 108 does mate with the arrow 106 on the positioning nut 50, the tabs 104 will clear the interrupted flange 33 and the pointer 29 will be pointed in the same direction as the arrow.

The cap 28 is also prevented from being removed from the shaft assembly until the shaft assembly has been turned far enough to positively align the corresponding floating contact with the fixed contacts 16. This assures positive engagement of the floating contacts with two of the fixed contacts 16 in each position of the shaft assembly. The same alignment is required to remove the cap from the shaft assembly in that the tabs 104 must be aligned with the slots 102 in the flange 33 before the cap can be removed from the housing. Once it has been removed, the cap is inverted and remounted on the threaded section 18 of the housing.

The housing design is unique in that it can be molded in a single shot without secondary operations. This has been accomplished by means of the relationship of the two interrupted flanges 32, 33 at the end of the bore 30. The slots 102 of the interrupted flange 33 are aligned with the tabs which form the interrupted flange 32. This staggered relation makes it possible to injection mold the housing using mold dies which interrelate to form the two sets of positioning flanges.

The housing's internal diameters are molded to serve as dual bearing supports for the switch shaft assembly 24, 26 and limit the compressive stress upon the "O" ring seals. The stepped coaxial mating diameters of the centering ring 44, 76 and the flanges 40, 72 on shafts 38, 70, respectively, provide positive alignment of the shaft assemblies in the housings.

The embodiments of the invention in which an exclusive property or privilege is claimed are defined as follows:

1. A multiposition rotary switch comprising a housing having a bore forming a bearing surface, an interrupted flange at one end of said bore having a series of slots, a rotatable switch assembly including a shaft mounted for rotary motion in said bore, said shaft including a driven member at one end and a key on said driven member, and a closure cap selectively mountable on said housing to enclose said bore, said cap including a boss having a series of tabs around said boss corresponding to the slots in said interrupted flange and a drive recess in said boss corresponding to said driven member on said shaft and a key recess in said boss to engage said key on said driven member whereby said cap cannot be rotated until all of said corresponding recesses are properly aligned with said driven member and said key.

2. The switch according to claim 1 wherein said housing includes a number of contacts mounted on the housing at the other end of said base, said rotatable switch assembly including a contact holder mounted on the other end of said shaft and floating contact means mounted in said holder for operatively engaging two of said contacts in each position of said switch assembly.

3. The rotary switch according to claim 2 wherein each floating contact means includes an electrically conductive element and a spring mounted in said holder in a position to bias said conductive element into engagement with said contacts.

4. The switch according to claim 3 wherein said conductive element comprises a hollow tubular electrically conductive contact.

5. The switch according to claim 3, wherein said conductive element comprises an elongate "c" shaped electrically conductive contact.

6. The rotary switch according to claim 1 including stop means at the other end of said bore and a tab on said shaft positioned to engage said stop means for limiting the rotary motion of said switch assembly.

7. The switch according to claim 1 including a second flange intermediate the ends of said bore, said shaft being mounted for rotary motion within said second flange, and including ring means on said shaft for locking said shaft in said second flange.

8. The switch according to claim 7 wherein said second flange includes a series of slots offset from the slots in said interrupted flange whereby said housing can be injection molded in one operation.

9. A multiposition rotary switch comprising a housing having an axial and a counterbore at one end of said housing, a number of contacts mounted on said one end of said housing in a spaced relation around said counterbore, a rotatable switch assembly mounted in said bore, said assembly including a shaft having a recessed contact holder at one end and a driven member at the other end, floating contact means positioned in said holder for operatively connecting two of said contacts in each position of said shaft and a cap selectively mountable on said housing in one position to form a closure around the driven member of said shaft and mountable on said driven member on said shaft in the other position for turning said shaft assembly in said bore.

10. The rotary switch according to claim 9 wherein each floating contact means includes an electrically conductive element and a spring mounted in said recessed holder in a position to bias said conductive element into engagement with said contacts.

11. The switch according to claim 9 or 10 wherein said floating contact means includes a hollow tubular electrically conductive contact.

12. The switch according to claim 9 or 10 wherein said floating contact means includes a pair of elongate "c" shaped electrically conductive contacts.

13. The rotary switch according to claim 9 including a stop flange formed on said one end of said bore and a tab formed on said switch flange in a position to engage said stop flange for limiting the rotary motion of said shaft.

14. The switch according to claim 9 or 13 including an interrupted flange at the other end of said bore having a series of slots and said driven member is in the form of a hex member having an arrow molded thereon, and said closure cap includes a boss having a shape corresponding to said hex member and an arrow-shaped recess in said boss to engage said arrow whereby said cap cannot be rotated until said arrow-shaped recess mates with said arrow.

15. A housing for a multi-position rotary dual voltage or tap changer transformer switch including a shaft assembly with moveable contact means, said housing comprising a molded plastic member having a bore forming a bearing surface for said shaft assembly, an interrupted mounting flange located intermediate the end of the bore for retaining said shaft assembly in the bore of the housing and an interrupted key flange at one end of the bore for providing a rotary lock release for said shaft assembly, said flanges each including slots, the slots in one flange being offset from the slots in the other flange and a number of fixed contacts mounted on the other end of said housing in an equally spaced relation to said bore, whereby said shaft assembly can be positioned in said bore for selectively electrically connecting said fixed contacts.

* * * * *